US008033759B2

(12) United States Patent
Davidsaver et al.

(10) Patent No.: US 8,033,759 B2
(45) Date of Patent: Oct. 11, 2011

(54) MODULAR RETAINING WALL

(75) Inventors: John E. Davidsaver, Kent, OH (US); Scott Yeany, Bogart, GA (US)

(73) Assignee: Trueline, LLC, Naples, FL (US)

( * ) Notice: Subject to any disclaimer, the term of this patent is extended or adjusted under 35 U.S.C. 154(b) by 0 days.

(21) Appl. No.: 12/543,833

(22) Filed: Aug. 19, 2009

(65) Prior Publication Data

US 2010/0034598 A1 Feb. 11, 2010

Related U.S. Application Data

(63) Continuation of application No. 11/751,817, filed on May 22, 2007, now Pat. No. 7,628,570, which is a continuation-in-part of application No. 10/904,348, filed on Nov. 5, 2004, now abandoned.

(51) Int. Cl.
*E04B 2/00* (2006.01)

(52) U.S. Cl. ..... 405/284; 52/439

(58) Field of Classification Search ..... 405/262, 405/284, 286, 276–279, 281, 274; 52/439, 52/309.15, 309.17, 309.9, 309.12, 580, 588.1, 52/579, 604, 433, 592.1, 592.3
See application file for complete search history.

(56) References Cited

U.S. PATENT DOCUMENTS

| | | | |
|---|---|---|---|
| 972,059 | A | 10/1910 | Clarke |
| 1,332,655 | A | 3/1920 | Willard |
| 1,371,709 | A | 3/1921 | Stockfleth |
| 1,422,821 | A | 7/1922 | Boardman et al. |
| 1,947,151 | A | 2/1934 | Caples |
| 2,525,547 | A | 10/1946 | Hayden |
| 2,968,931 | A | 1/1961 | McGrath |
| 3,247,673 | A | 4/1966 | Schneller |
| 3,541,798 | A | 11/1970 | Schnabel, Jr. |
| 3,822,557 | A | 7/1974 | Frederick |
| 4,075,799 | A | 2/1978 | Lemelson |
| 4,099,359 | A | 7/1978 | Sivachenko |
| 4,407,612 | A | 10/1983 | van Weele |
| 4,674,921 | A | 6/1987 | Berger |
| 4,690,588 | A | 9/1987 | Berger |
| 4,863,315 | A | 9/1989 | Wickberg |
| 4,917,543 | A | 4/1990 | Cole et al. |
| 5,066,353 | A | 11/1991 | Bourdo |
| 5,145,287 | A | 9/1992 | Hooper et al. |
| 5,216,863 | A | 6/1993 | Nessa et al. |

(Continued)

FOREIGN PATENT DOCUMENTS

| | | |
|---|---|---|
| JP | 05-311643 | 11/1993 |

(Continued)

OTHER PUBLICATIONS

PCT/US2008/064285 Korean Written Opinion, Form PCT/ISA/220.

(Continued)

*Primary Examiner* — Sunil Singh
(74) *Attorney, Agent, or Firm* — Hahn Loeser & Parks LLP

(57) ABSTRACT

A modular retaining wall is illustrated and described having open or closed polygonal modules with channels disposed therein. The wall is set at least partially below a surface, the surface either being land-based or aqueous-based, and interfaces therebetween, e.g., shoreline. The modules of the wall are fastened to each other by respective fastening means such that engaging connectivity is provided between the modules, yet retains the ability for fluid to pass through.

6 Claims, 17 Drawing Sheets

U.S. PATENT DOCUMENTS

| | | | | |
|---|---|---|---|---|
| 5,292,208 | A | 3/1994 | Berger | |
| 5,465,545 | A | 11/1995 | Trousilek | |
| 5,580,191 | A | 12/1996 | Egan | |
| 6,000,883 | A | 12/1999 | Irvine et al. | |
| 6,033,155 | A | 3/2000 | Irvine et al. | |
| 6,042,306 | A | 3/2000 | Arndts et al. | |
| 6,092,346 | A * | 7/2000 | Even et al. | 52/579 |
| 6,219,984 | B1 | 4/2001 | Piccone | |
| 6,575,667 | B1 | 6/2003 | Burt et al. | |

FOREIGN PATENT DOCUMENTS

| | | |
|---|---|---|
| JP | 2001-348862 | 12/2001 |

OTHER PUBLICATIONS

PCT/US2008/064285 WIPO International Preliminary Report on Patentability, Form PCT/ISA/373.

* cited by examiner

MODULAR RETAINING WALL

CROSS-REFERENCE TO RELATED APPLICATIONS

This application is a continuation of patent application Ser. No. 11/751,817 filed on May 22, 2007 now U.S. Pat. No. 7,628,570, which is a continuation-in-part of patent application Ser. No. 10/904,348 filed on Nov. 5, 2004, now abandoned.

TECHNICAL FIELD

This invention relates generally to retaining walls, and more specifically to retaining walls for use in controlling land erosion in contact with water.

BACKGROUND OF THE INVENTION

Over the many years, there has long existed the problem of land erosion adjacent waterways, rivers, lakes and oceans wherein seawalls of various types have heretofore been constructed of wood, steel or cement. Heretofore, efforts have been made to provide a series of seawall elements which are laterally aligned and in some manner interconnected and pounded down into the ground and anchored. Illustrative of earlier prior art efforts to provide a seawall, constructed of reinforced concrete, is U.S. Pat. No. 1,332,655 issued to R. B. Willard in 1920. The problem then as recognized by the inventor and thereafter, has been the enormous pressures and loads applied to the seawall which have ultimately destroyed the connection between adjacent seawall elements to render the seawall less than effective and ultimately requiring replacement and repairs.

It is known to form seawalls of a plurality of panels formed of extruded PVC material and interconnected edge to edge, as shown in Berger, U.S. Pat. No. 4,674,921 issued Jun. 23, 1987 and U.S. Pat. No. 4,690,588 issued Sep. 1, 1987. In Berger, panel strips of corrugated or sinusoidal shape are formed with alternating groove edges and tongue edges, permitting the panels to be interlocked along their vertical marginal edges. Wale elements are mounted along outer surfaces of the panel strips and accept tie bolts or tie rods extending to ground anchors on the opposite side of the seawall. Berger also discloses angled strips for making corners, and connectors for joining adjacent strips in edge-to-edge relation.

Sinusoidal or corrugated sheets have been mounted in facing relation and connected or joined by tie rods, and the spaces therebetween have been filled with concrete or mortar to provide a water-tight joint, to form a revetment, as shown in Schneller, U.S. Pat. No. 3,247,673 of Apr. 26, 1966.

Sinusoidal or corrugated panel sections have been used to make up retaining walls or seawalls, with wale elements on a front surface tied back to anchors, as shown in a number of prior patents. Caples, U.S. Pat. No. 1,947,151 of Feb. 13, 1934 shows panel sections formed with interconnecting locking vertical edges in alternating inwardly and outwardly directed portions to form a sinusoidal wall. In Caples, the interlocking ends are identical. In Frederick, U.S. Pat. No. 3,822,557 of Jul. 9, 1974, one panel vertical edge is formed with a tongue and the opposite panel vertical edge is formed with a groove proportioned to receive the tongue of an adjacent panel.

Another example of a retaining wall made of interlocking sections of sheet material is McGrath, U.S. Pat. No. 2,968,931 of Jan. 24, 1961. In McGrath each panel section is bent into three angular portions, and each panel section is reversed when connected, edge to edge to form a sinusoidal-like pattern.

Earlier examples of wall systems having interlocking panel sections which are assembled in longitudinal alignment, with interlocking vertical edges, include Clarke, U.S. Pat. No. 972,059 of Oct. 4, 1910; Boardman et al, U.S. Pat. No. 1,422,821 of Jul. 18, 1922; and Stockfleth, U.S. Pat. No. 1,371,709 of Mar. 15, 1921.

It is also known to use a series of individual arcuate sections which are then joined or interconnected to form a retainer wall, as shown in Van Weele, U.S. Pat. No. 4,407,612 of Oct. 4, 1983.

While walls formed by corrugated panel sections are extensively shown in the prior art in which the corrugations or the axes of the corrugations run vertically, is also known to form panel sections in which the axes of the corrugations run horizontally, as shown in Sivachenko U.S. Pat. No. 4,099,359 of Jul. 11, 1978. FIGS. 7 and 8 also show opposed facing pairs of corrugated sections in which the spaces therebetween may be filled with concrete to form a revetment.

It is common to use wale brackets or wale elements in combination with panel-type seawalls or retainer walls. Berger, Schnabel, Jr. and Caples show wale elements in longitudinal alignment. Schnabel, Jr., U.S. Pat. No. 3,541,798 of Nov. 24, 1970 shows individual longitudinally spaced wale elements along the wall front face. The wale elements receive tie-back rods, which rods extend through or between the panels to suitable anchors.

Essentially two-dimensional polymeric retaining wall members with interlocking members along the edges that are universally mateable to like members are illustrated in U.S. Pat. No. 4,863,315, issued Sep. 5, 1989 to Wickberg while a wall system which employs a plurality of individual panels formed of extruded polymer joined in edge-to-edge relation including wale members which are vertically offset and interlocked at end portions thereof with adjacent wale members is shown in U.S. Pat. No. 4,917,543, issued Apr. 17, 1990 to Cole et al.

A shoreline erosion prevention bulkhead system which employs a series of interlocking fiberglass panels is shown in U.S. Pat. No. 5,066,353 issued Nov. 19, 1991, to Bourdo while a plastic structural panel and ground erosion barrier is illustrated which in general is a stretched Z-shaped cross-sectional design with opposed male and female interlock edges for mating association with adjacent panel strips in U.S. Pat. No. 5,145,287 issued Sep. 8, 1992 to Hooper et al.

Corner adapters for use with corrugated barrier sections are disclosed in U.S. Pat. No. 5,292,208 issued Mar. 8, 1994 to Berger and a sheet piling extrusion with locking members is illustrated in U.S. Pat. No. 6,000,883 to Irving et al. A reinforced Z-shaped configuration of the same with strengthening ribs is illustrated in U.S. Pat. No. 6,033,155 issued Mar. 7, 200 to Irvine et al. A generally U-shaped seawall panel is disclosed in U.S. Pat. No. 6,575,667 issued Jun. 10, 2003 to Burt et al.

This invention was developed to continue to advance the state-of-the-art for retaining walls, particularly extruded polyvinyl chloride (PVC) retaining walls which offer easier installation and greater structural integrity than those found in the Prior Art.

SUMMARY OF THE INVENTION

It is an aspect of the present invention to provide a modular barrier or retaining wall, particularly for use in tidal environments where land erosion is a particular problem.

It is another aspect of the invention to provide a modular barrier wall which utilizes linear U-shaped (optionally polygon-shaped—whether open or closed polygon) channel modules and angled (optionally polygon-shaped—whether open or closed polygon) channel modules which through mating engagement of male projections and female receptacles, effect wall construction which is self-aligning.

It is still yet another aspect of the invention to provide a modular retaining wall which permits wall construction to angle either outward or inward by inserting the appropriate end of an angled module, the angled module being essentially a mirror-image of each other as viewed through a bisecting horizontal line through the angled module.

It is a further aspect of the invention to improve on existing seawall "sheet pilings" of plastic material by exposing a smooth face toward both the sea and the land using a substantially rigid three-dimensional structure which employs a double connection system which is locked into a fixed location. A connection hook is employed which allows for clearing of external material during installation. The final structure is hollow and can be filled with gravel, concrete, etc., to achieve a higher strength. The smooth surfaces are not only more visually appealing, but also make installation easier due to the ease of concrete form construction. Additionally, angled modules are provided which allow for a radiused appearance.

It is still a further object of this invention to employ a two point connection that makes for faster installation because the three-dimensional profile cannot twist or bow to the degree of existing two-dimensional products. This means less driving energy will be absorbed by the pile making it faster to drive. It also reduces rework required to correct misplaced piles in that they will not have to be withdrawn and replaced.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE DRAWINGS

The invention is described with reference to the accompanying figures, which illustrate the best mode known to the inventor at the time of the filing of the application illustrating the modular retaining wall of the invention.

Figure 1:
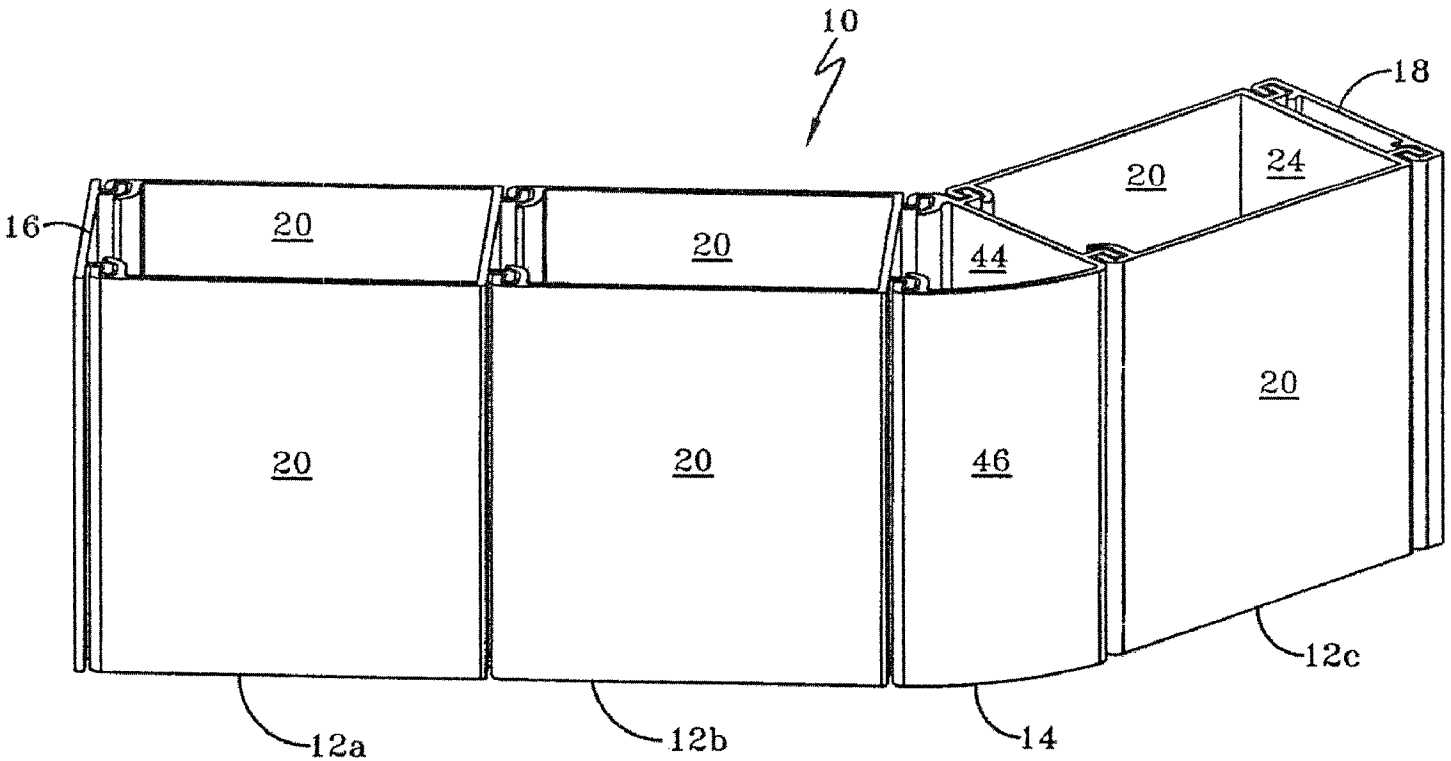
FIG. 1 is a perspective view of the modular retaining wall illustrating a 45° bend interposed therein with end caps positioned at opposed ends of the wall.

As better illustrated in FIG. 1, retaining wall 10 consists of various modules which form a contiguous barrier wall across a length of the modules when in their assembled state. Some modules are essentially interlocking linear U-shaped channels, e.g., 12*a*, 12*b*, and 12*c* whereas other interlocking modules, e.g., angled module 14, are used to impart non-linearity to the wall. As illustrated in the figure, the imparted angle is approximately 45°, although this is but an example of any angle between 1° and 180°, the end-use application, which in an aqueous environment will be the shoreline defining the requisite angularity required for the non-linear modules. The combination of linear U-shaped modules with non-linear modules provides essentially limitless geometries for retaining wall 10. At each end of the wall, is an end-cap 16, 18, with an appropriate geometry so as to interlock or mate with its adjacent module, whether that module is linear or angled.

Figure 2:
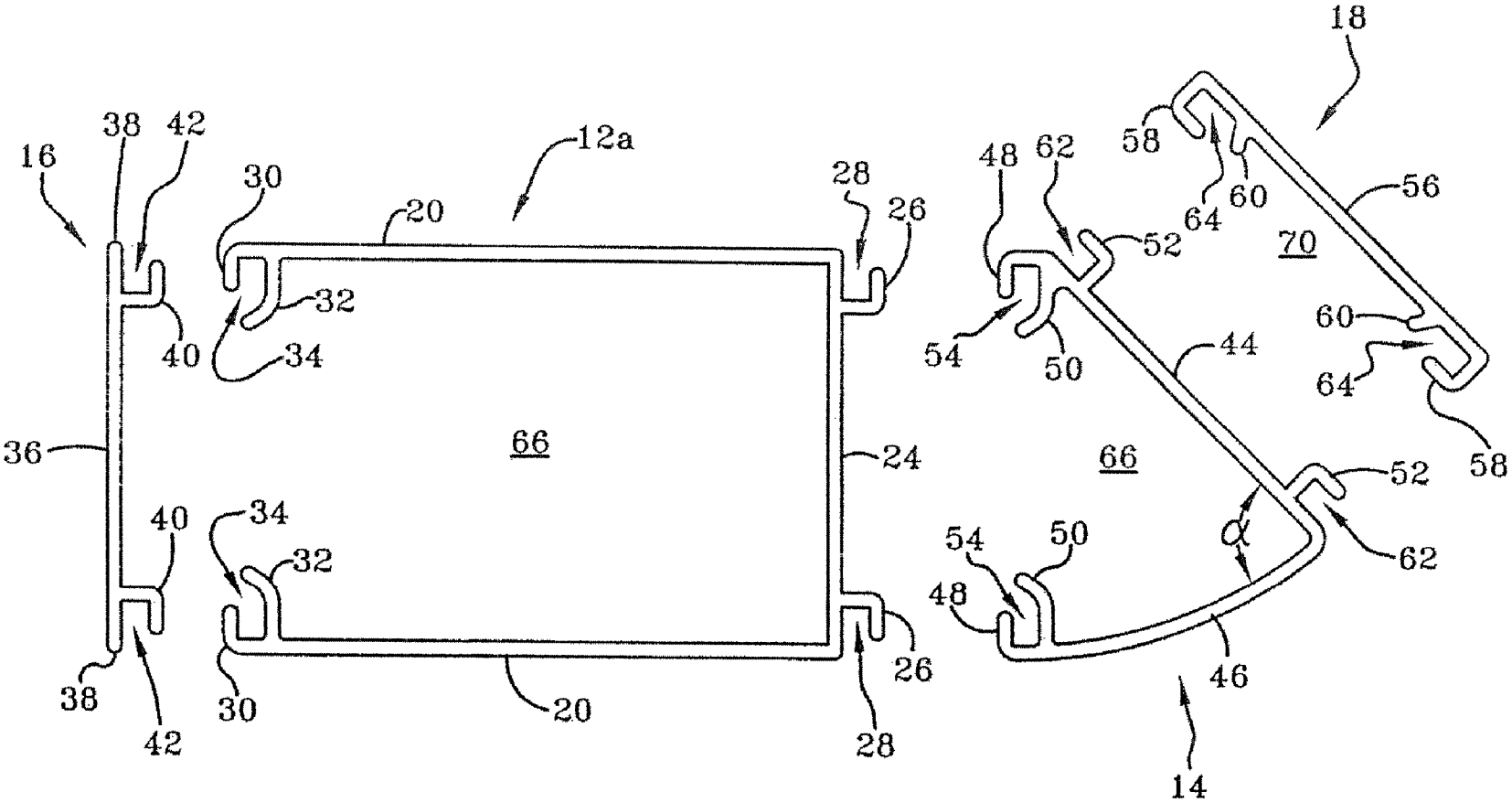
FIG. 2 is a top plan view of one module of FIG. 1.

As better illustrated in FIG. 2, a combination of one linear U-shaped channel module 12*a* with adjacent angled channel 14 with respective end caps 16, 18 is shown in an unassembled state. Linear module 12*a* is comprised of a pair of essentially parallel vertically-extending sides 20 in connected engagement with an essentially vertical third side 24 positioned normal to the vertical plane of sides 20 at one end of each side 20 forming an essentially open "U-shaped" channel 66 within module 12*a*. Affixed to the exterior of third side 24 and positioned interiorly of each of the ends of the side, is a pair of outwardly facing "J-shaped" or "U-shaped" hook protrusions 26 defining an open longitudinal channel 28. Affixed to each end of lateral sides 20 at the open end of U-shaped channel 66 are a pair of inwardly facing end wall segments 30. Spaced apart from end wall segments 30 and penetrating inwardly and curvilinearly toward the open end of the channel are interior curvilinear wall segment protrusions 32, the combination of end wall segments 30 and interior curvilinear wall segment protrusions 32 defining open vertically-extending longitudinal channel 34. While curvilinear wall segments 32 are defined as curvilinear, in an alternative embodiment, these segments could be intersecting linear segments, the end-use application defining the need for a geometry which is either curvature-based or intersecting perpendicular line based in a manner similar to that defined for outwardly-facing J-shaped hooks 26.

In constructing retaining wall 10, either a second linear U-shaped channel module 12*b* is attached to the first linear U-shaped channel module 12*a* or a non-linear or angled module 14 is affixed through mating channels and protrusions. As illustrated in FIG. 2, a non-linear module 12*b* is shown adjacent to the closed end of linear U-shaped module 12*a*. This angled module, shown to produce an angle of approximately 30°, although both larger and smaller angles are within the scope of this invention, ranging from 1° to 180° are envisioned. Angled module 14 is essentially J-shaped or hook-shaped in which side 44 and curvilinear or curved side 46 intersect, the degree of curvature defined by an angle $\alpha$ (shown to be approximately 45° in the Figure) formed by the intersection of the vertical plane of side 44 and the vertical plane of curvilinear side 46. In a manner analogous to that discussed with vertical third side 24 of linear module 12*a*, and affixed to the exterior of side 44 and positioned interiorly of each of the ends of this side, is a pair of outwardly facing "J-shaped" hook protrusions 52 defining an open longitudinal channel 62. Affixed to non-intersecting end of side 44 at the open end of open triangular shaped channel 68 and to non-intersecting end of curvilinear side 46 at the same open end of channel 68 is a pair of inwardly facing end wall segments 48. Spaced apart from end wall segments 48 and penetrating inwardly and curvilinearly toward the open end of the channel are interior curvilinear wall segment protrusions 50, the combination of end wall segments 48 and interior curvilinear wall segment protrusions 50 defining open longitudinal channel 54. While curvilinear wall segments 50 are defined as curvilinear, in an alternative embodiment, these segments could be intersecting linear segments, the end-use application defining the need for a geometry which is either curvature-based or intersecting perpendicular line based in a manner similar to that defined for outwardly-facing J-shaped hooks 26.

Attachment of angled module 14 to a linear module, e.g., 12*a* or 12*b* or 12*c*, is effected by mating engagement of male J-shaped hook protrusion 26 into open female longitudinal channel 54 formed by end wall segments 48 and curvilinear segments 50. By having mating engagement occur with two channels simultaneously, the modules become self-aligning.

Retaining wall 10 is constructed by matingly securing linear U-shaped modules 12 and angled modules 14 in combination to meet the geometry required by the end-use application. It is recognized that since the modules are mirror images when dissected through a horizontal plane, that the direction of the turn of the retaining wall through the utilization of an angled module can be in either direction by simply turning the angled module upside-down. At either end of the retaining wall, is an end cap, the configuration of which is dictated by whether the end cap is designed to close an open U-shaped channel or to mate with a pair of outwardly facing J-shaped hooks. In FIG. 2, channel closing end cap 16 is constructed with side 36 essentially parallel to third side 24 at the closed end of channel 66. Spaced inwardly and interiorly of each opposed end 38 of the end cap is a pair of outwardly facing "J-shaped" hook protrusions 40 defining an open longitudinal channel 42. Attachment of channel closing end cap 16 with linear module 12*a* occurs via mating engagement of male J-shaped hook protrusion 40 into female longitudinal channel 34 formed by end wall segments 30 and curvilinear segments 32. At the opposed end of retaining wall 10 from channel-closing end cap 16 is terminating cap 18 having a side 56 with a pair of inwardly facing J-shaped hooks 58 at each end with a pair of inwardly facing fingers 60 spaced apart and inward from the pair of J-shaped hooks. Attachment of terminating end cap 18 with angular module 14 occurs via mating engagement of male J-shaped hooks 52 into open female longitudinal channels 64 formed by J-shaped hooks 58 and inwardly facing fingers 60 thereby closing and simultaneously forming channel 70 between side 56 of terminating end cap 18 and side 44 of angled module 14.

Figure 3:
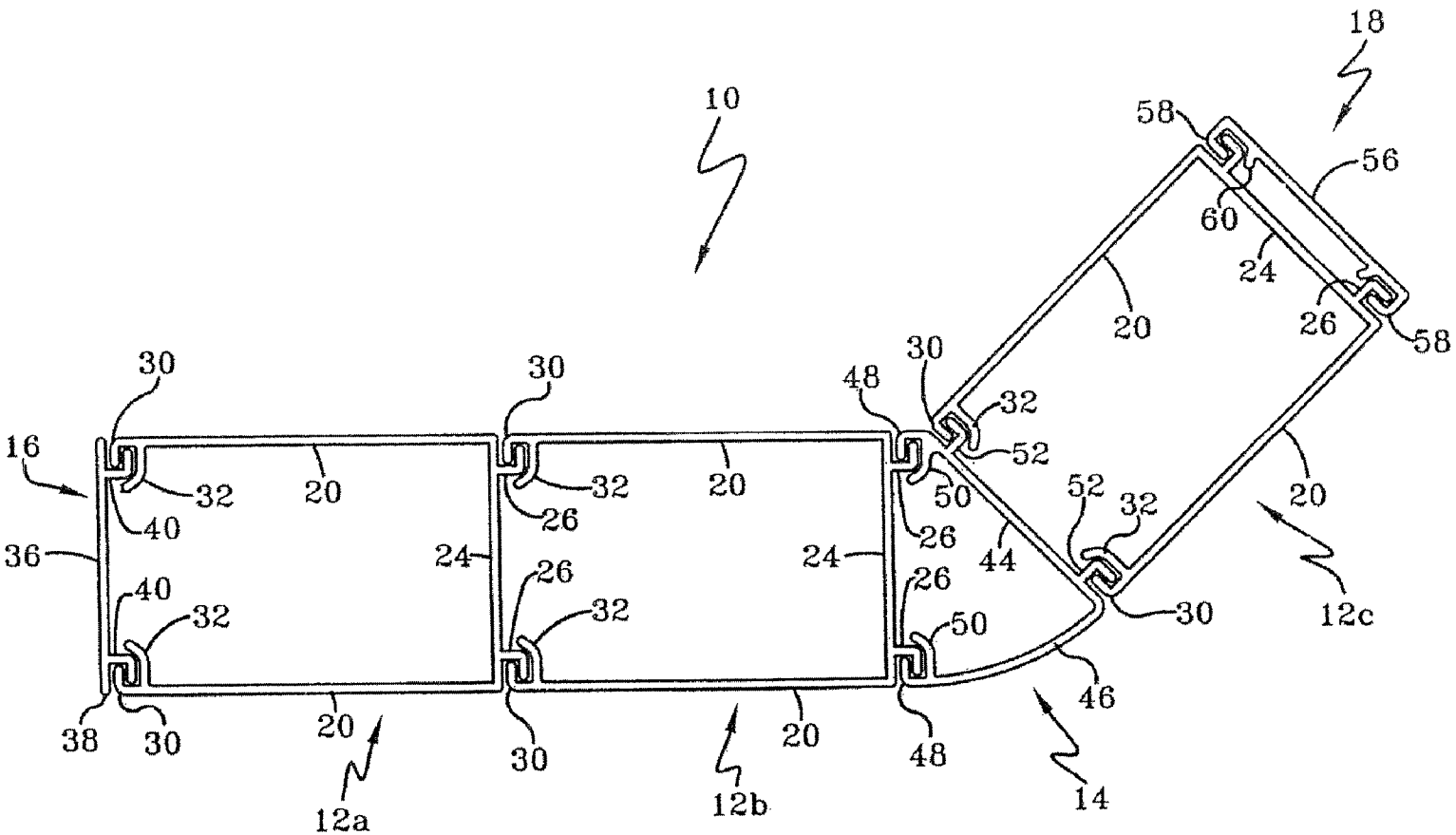
FIG. 3 is a top plan view of FIG. 1.

As illustrated in FIG. 3, terminating end cap need not be affixed to angled module 14, but rather could also terminate a linear U-shaped channel module 12*c*. Attachment of terminating end cap 18 with linear module 12*c* occurs via mating engagement of male J-shaped hooks 26 into open female longitudinal channels 64 formed by J-shaped hooks 58 and inwardly facing fingers 60 thereby capping retaining wall 10.

Figure 4:
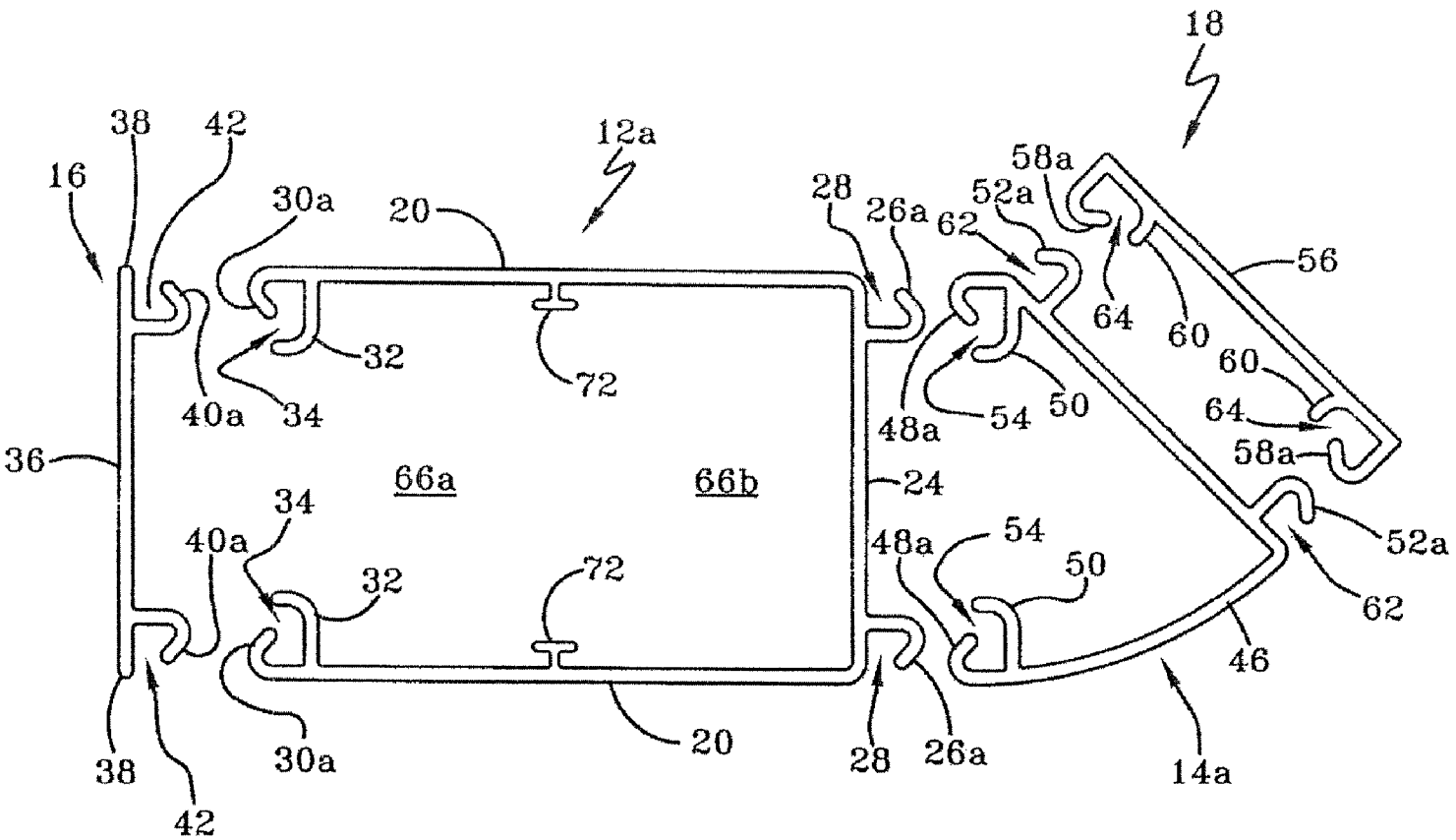
FIG. 4 is a top plan view of an embodiment of the modular retaining wall illustrating the incorporation of a middle retaining rib and a different linking geometry.
Figure 5:
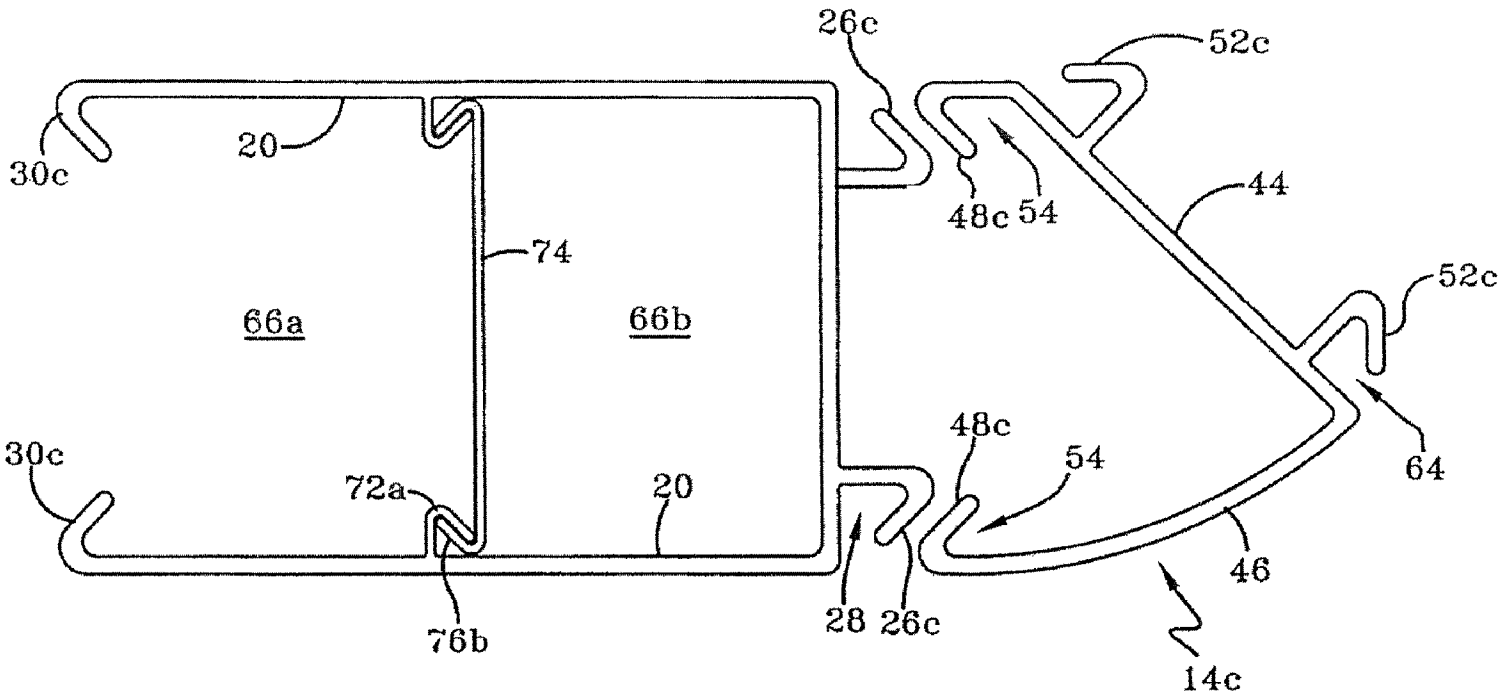
FIGS. 5-7 are top plan views of alternative embodiment of the modular retaining wall illustrating alternative linking geometries including middle side wall support.
Figure 6:
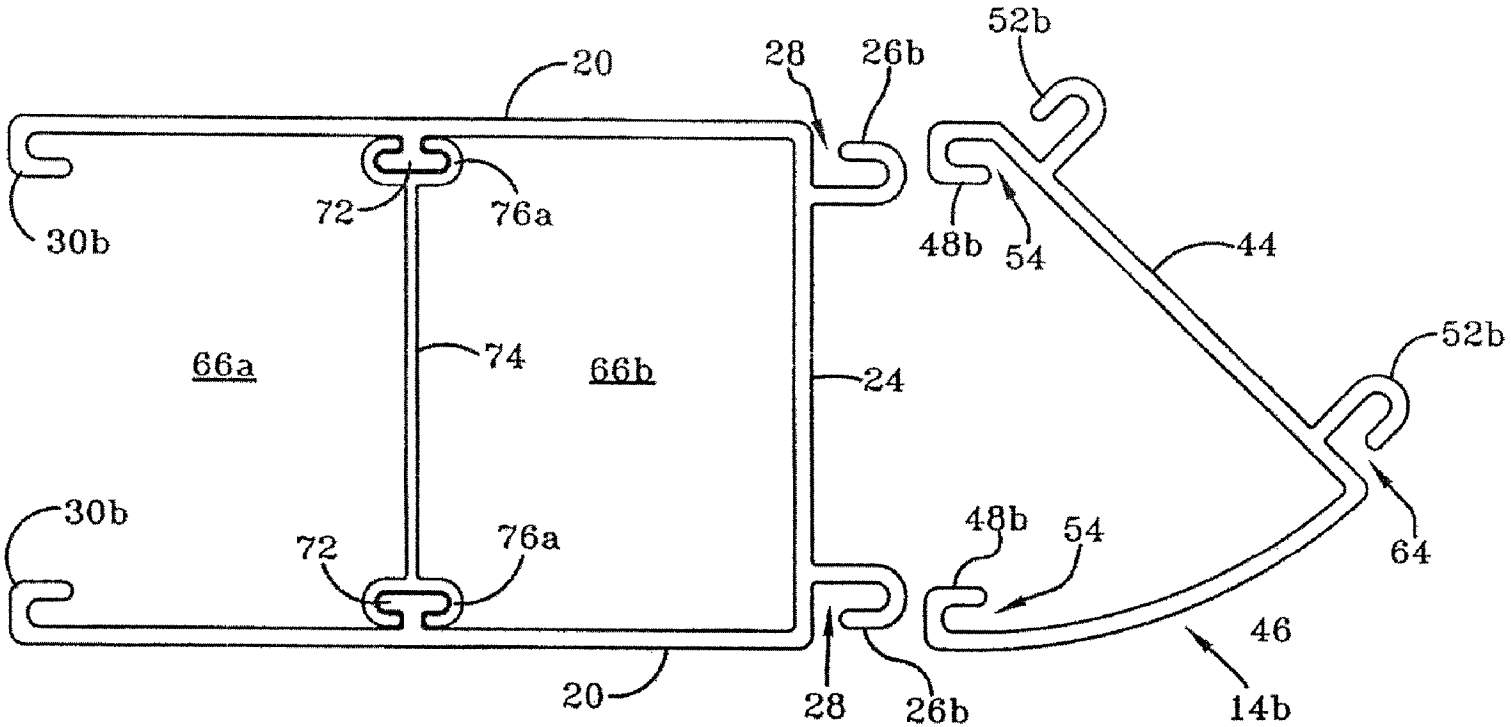
Figure 7:
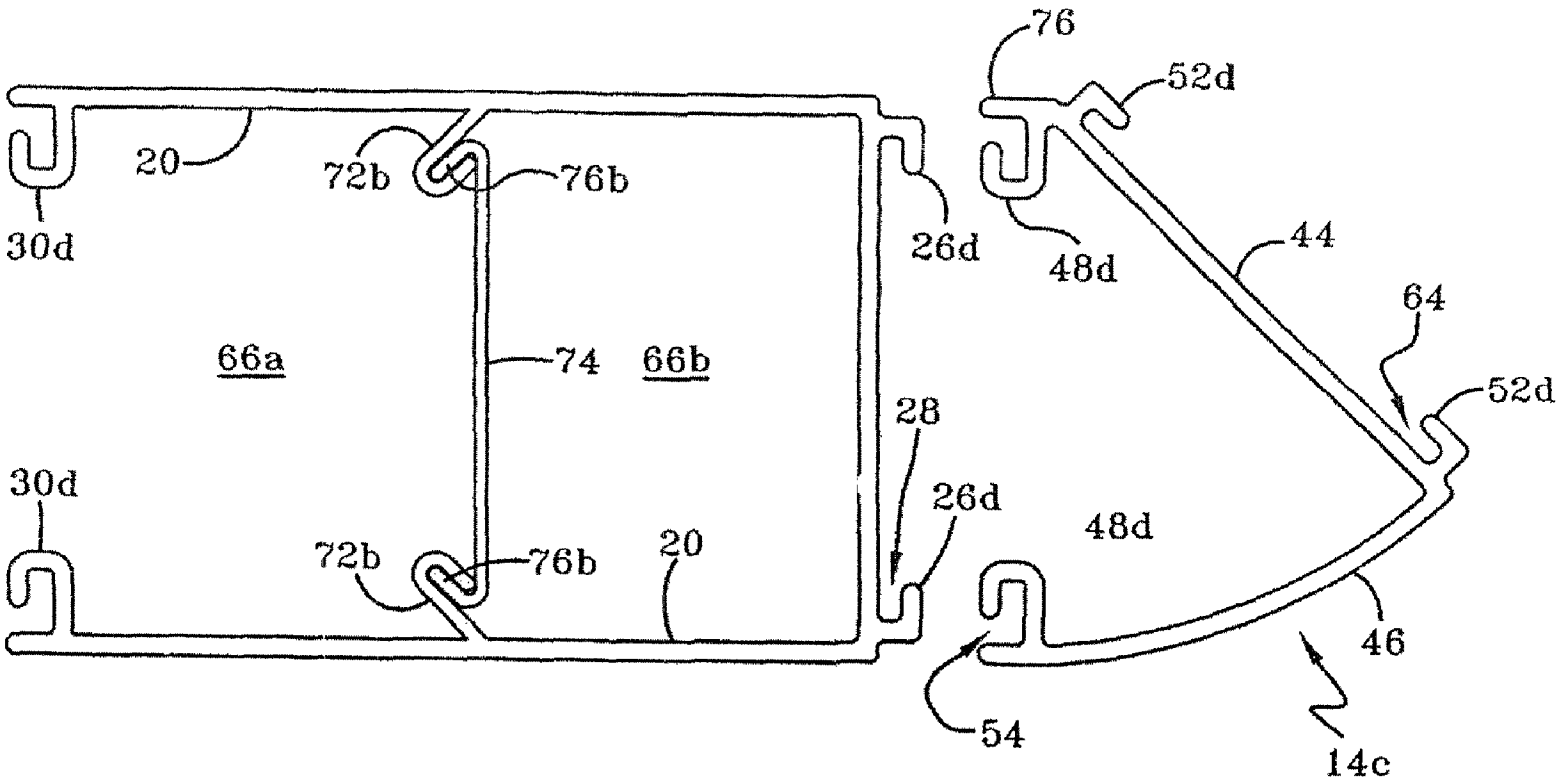

As used in the field and in a preferred embodiment only, subsequent to driving the modules into the seabed using mechanized driving equipment, each closed cavity which is formed through mating engagement with a subsequent module, is filled with pea gravel or concrete or combinations thereof. The filling operation creates outward lateral pressure on each module. For those modules which have relatively small horizontal dimensions, the inherent structural strength of the walls of the module are sufficient to resist any lateral bowing of the module. However, for those modules which have a larger horizontal dimension, e.g., 12*a*, 12*b*, 12*c* in the Figures, it is often desirable to include T-shaped (or other geometried) male anchors 72 positioned on opposing side walls 20 on the inside of cavity 66, thereby forming two separate cavities, 66*a* and 66*b*. This lessens the tendency of the larger modules to lateral bowing when the male anchors 72 are in mating engagement with at least one rib 74 (better illustrated in FIGS. 5-7) which are in mating engagement with the male anchors While a pair of T-shaped male anchors 72 are illustrated in FIGS. 4, 6 and shown to be in engagement with a rib 74 having a pair of open oval channels 76*a* positioned at each end of the rib for mating engagement with the male anchors, there is no need to limit the invention to this geometry. As illustrated in FIGS. 5, 7, reinforcing rib 74 can mate with male anchors 72*a* (inwardly facing bent finger positioned normal to the vertical plane of wall 20) or 72*b* (inwardly facing bent angular finger). When in either of these geometries, it is important that the geometry of the opposed ends 76*b* of reinforcing rib 74 successfully mate or securely or lockingly engage with the male anchor.

As illustrated in FIGS. 4-7, each of the modules can have mating attachment locking mechanisms which employ slightly different geometries, and the invention is not limited to any one geometry. For example, inwardly facing wall segments 30 may be geometried as inwardly facing J-shaped hooks 30*b* which bend backwards 180°, or as inwardly facing J-shaped hooks 30*c* which form an acute angle with wall 20, said angle ranging from 1-90°, or as outwardly-facing J-shaped hooks 30*d*. Additionally J-shaped hooks 26 may be geometries as outward-facing J-shaped hooks 26*a* which form an acute angle to the initial normal projection from third end wall 24, said angle ranging from 1-90°, or outward-facing J-shaped hooks 26*b* which bend backwards 180°, or outward-facing J-shaped hooks 26*c* or inward-facing hooks 26*d*. Similarly, inwardly-facing wall segments 48, namely 48*a*, 48*b*, 48*c* or 48*d* may be possessed of different geometries, the key being mating or secure or locking engagement with their corresponding J-shaped hooks 26. Similar comments are pertinent to protrusions 52, namely 52*a*, 52*b*, 52*c*, and 52*d* which would need to correspondingly securely or matingly engage with their associated next modular unit.

Figure 8:
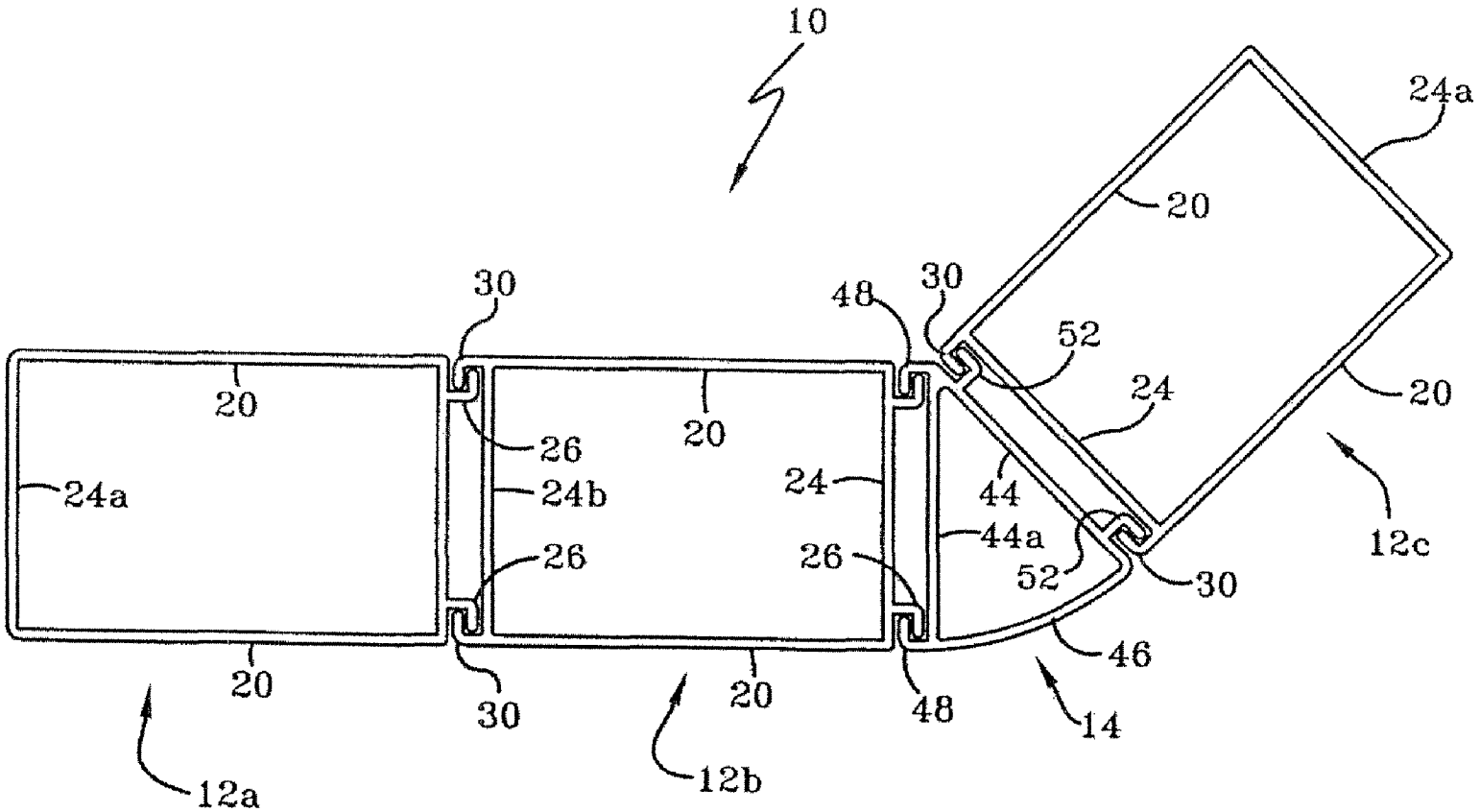
FIG. 8 is a top plan view of closed polygonal shaped modules for use in an embodiment of the retaining wall.

FIG. 8 illustrates a further embodiment of the modular retaining wall construction wherein each module is of a closed geometry for additional stability if required by the application. Module 12*a* comprises a closed rectangular polygon having a pair of parallel sides 20 and a pair of connecting ends. End 24*a* simply closes the polygon on one side and is used as a terminating end module to the retaining wall 10. When used in this configuration, there is no need for end cap 36 as illustrated in FIG. 3 for example. Opposed end 24 has a pair of outwardly-facing male J-shaped hook protrusions 26 for engagement with inwardly-facing J-shaped hooks of inner module 12*b*. This module is the building block module when the wall is constructed with closed polygon modules. Module 12*b* comprises similar parallel sides 20 with opposed end walls, one end wall having a pair of inwardly-facing J-shaped hooks 30 while opposed end 24 has a pair of outwardly-facing J-shaped hooks. Construction of the retaining wall includes linking as many modules 12*b* as is necessary until the wall either ends or is angled. When angularity is required to the construction of the wall, a closed triangular-shaped module is added to end 24 of module 12*b* through gripping or securing engagement of outwardly-facing J-shaped hooks 26 with inwardly-facing J-shaped hooks. Completion of a modular retaining wall is effected by the attachment of module 12*c*, a module similar to 12*a* with the exception that the securing fingers are inwardly-projecting J-shaped hooks 30 in contrast to the outwardly-facing J-shaped hooks 26 of module 12*a*.

Figure 10:
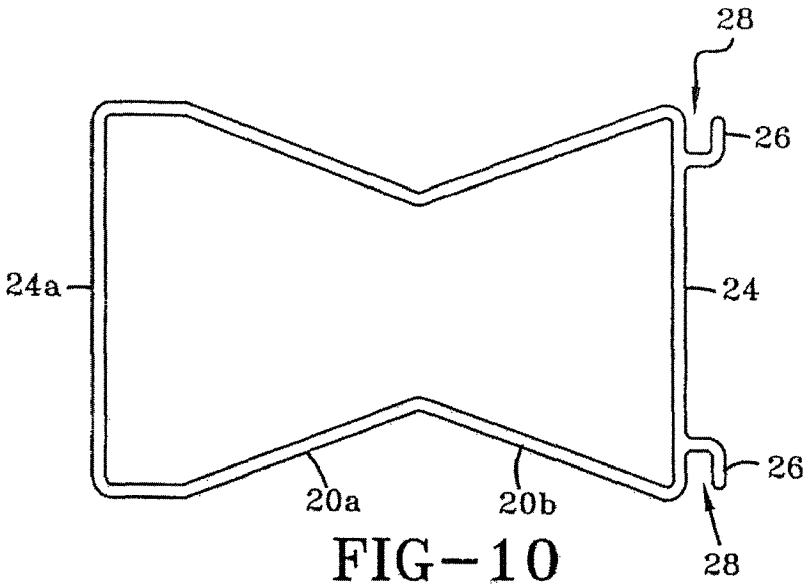
FIG. 10 is a top plan view of an end module of the retaining wall illustrating the closed polygon shape.
Figure 9:
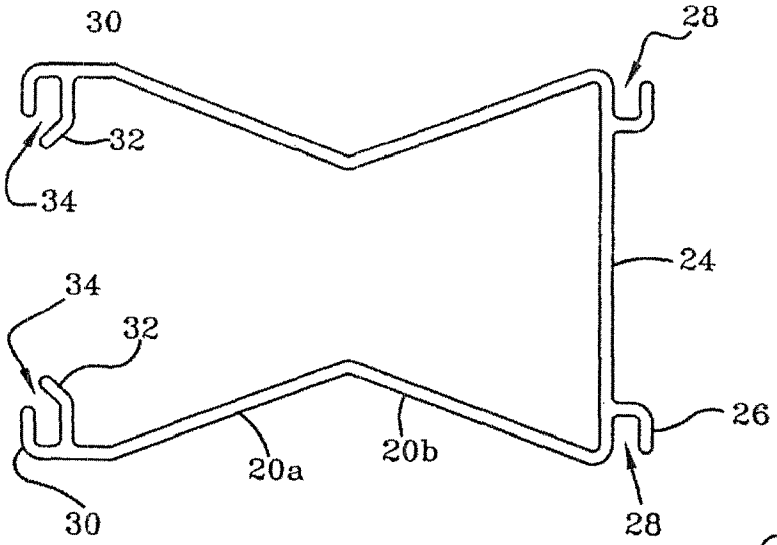
FIG. 9 is a top plan view of an end or middle module of the modular retaining wall illustrating the open polygon shape.
Figure 12:
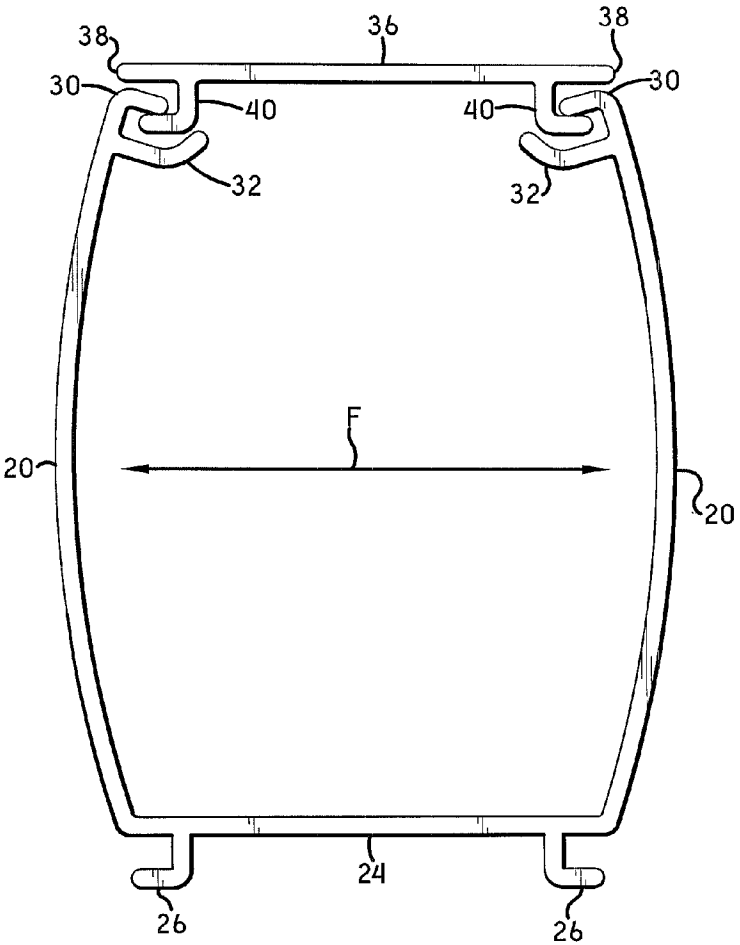
FIG. 12 is an expanded top plan view of the module of FIG. 11 illustrating the application of an outward force (F) in the middle of the module, typically due to filling with pea gravel and its associated impact and movement on the joint illustrating partial disengagement.
Figure 18:
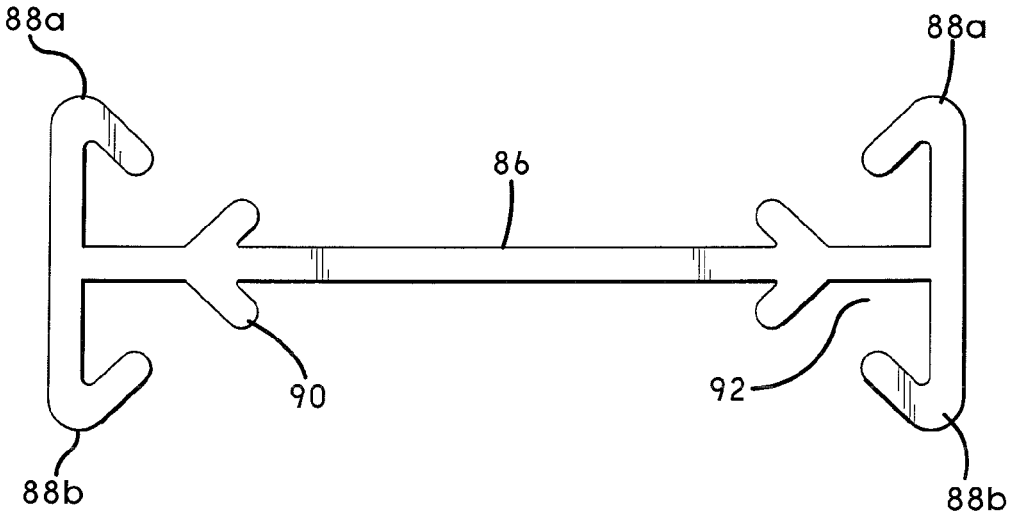
FIG. 18 is a top plan view of a reversing connector.

While the invention has been described in terms of open U-shaped modules and closed rectangular modules for the essentially linearly oriented modules, there is no need to limit the shape of the modules to such. In fact, as illustrated in FIGS. 9-10, both open and closed polygons are useful in the invention. As shown particularly in FIG. 9, end 12*a* or middle module 12*b* which was illustrated to be an open U-shaped three-sided polygon, may be envisioned as an open seven-sided polygon, wherein side panel 20 has been modified by inwardly-positioned side panels 20*a* and 20*b*. It is noteworthy that the apex of side panels 20*a* and 20*b* need not be equally spaced between bottom side 24 and end cap 36, but may be positioned off-center. It is also noted that the length of side panels 20*a* and 20*b* need not be equal. In a similar manner, this concept may be extended to the closed polygons which were originally shown to be rectangular in shape in FIG. 8, but are illustrated to be polygonal in FIG. 10. This concept may equally be extended to the non-linearly oriented modules, e.g., 14. Of note is that when constructing a seawall, it is possible to reverse the orientation of the modules, whether open or closed polygonal by the use of a reversing connector as illustrated in FIG. 18 having a cross member 86 with pair of oppositely facing inwardly projecting fingers 88*a*, 88*b* which form a channel 92 with protruding finger 90. The reversing module is affixed to an end of a seawall module.

Figure 19:
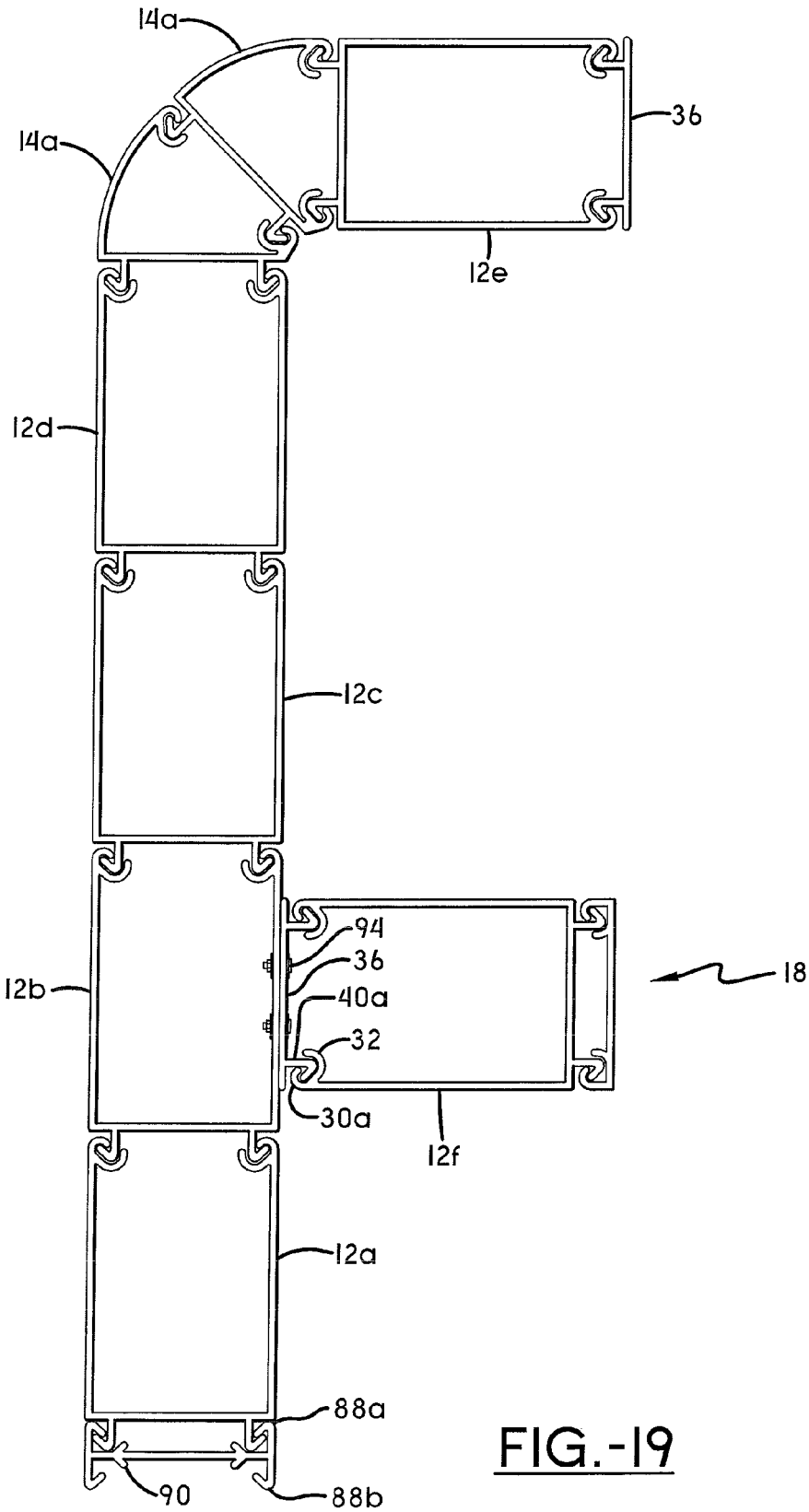
FIG. 19 is a top plan view illustrating curved sections, bolted add-on sections; and a reversing connector.

Shown in combination with other modules is the seawall illustrated in FIG. 19 in which U-shaped modules 12*a*, 12*b*, 12*c* and 12*d* are affixed in longitudinal linear alignment, with side wall module faces being essentially in planar arrangement, with minimal indentations at the joints. This is important in that minimizing indentations simultaneously minimizing eddying, which is a contributing factor in generating noise in tidal areas. Non-linear open modules 14*a* enable the wall to be bent at essentially a 45° angle, which in combination, can be joined to make angles of 90°, 135° and 180° with the option of attaching further modules e.g., 12*e* to the open end of the angled module with end cap 36. Obviously, by choosing a different angle of bend, e.g., 30°, it is possible to fabricate modules with different degrees of angularity, thereby making different amounts of bend in the wall, Additionally, by reversing the angled modules, it is possible to provide a more serpentine look to the wall, still maintaining the essentially contiguous vertical and horizontal planarity look to the wall even across the joints, this contiguity of look extending across even non-linear modules, e.g., 14*a*. For those instances where more than one seawall leg is desired, this "custom" build-on can be achieved by attaching an end cap 36 to side wall of one of the modules, e.g., 12*b* by at least one, preferably two fastening means 94 illustrated in FIG. 19.

One of the underappreciated aspects of the construction of a seawall is that the joints utilized to construct the seawall of the current invention are not intended to be essentially leak-tight. In fact, a certain amount of fluidity or non-contiguous contacting engagement is desired in order to allow water (or liquids or other fluids) the ability to flow from the land side of the seawall into the water-contacting side. Phrased alternatively, there is a contiguous fluid path across the module, which encompasses water flowing through the joints. The value of this resides in the fact that after heavy rainfalls, when pools of water form on the land side, the accumulated water can flow through the joints and water removal does not have to rely strictly upon soil permeation and/or evaporation for removal, but can additionally incorporate flow through the seawall joints.

Figure 11:
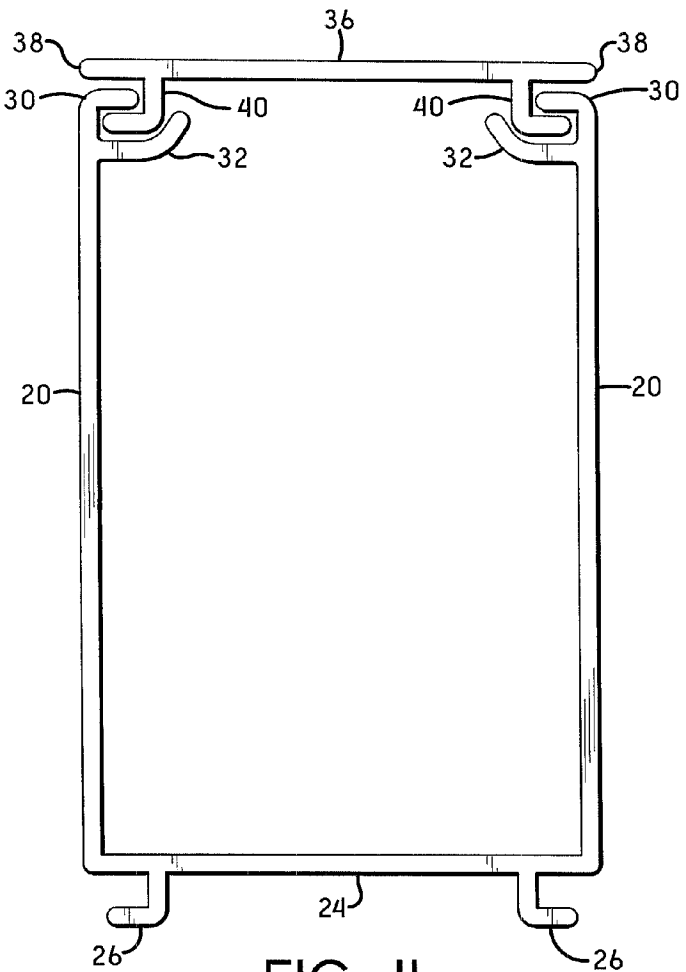
FIG. 11 is an expanded top plan view of an end module of the retaining wall illustrating the fastening of the end module with an open polygon shape with areas of non-contiguous contact or gaps in the joint to allow water or other fluid egress from one side of the wall to the opposite side.
Figure 13:
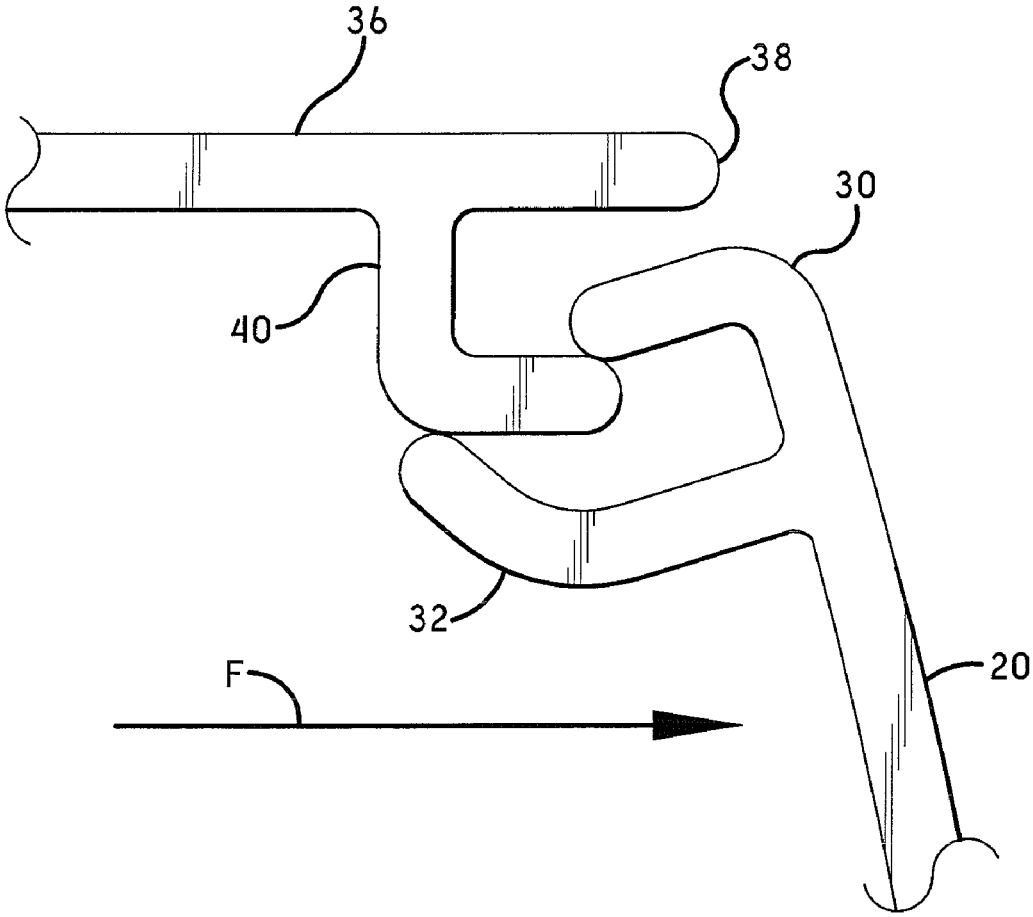
FIG. 13 is an exploded top plan view of one joint of FIG. 12 upon continued application of a lateral outward force (F) and its associated impact on the joint, illustrating the joint becoming dislodged.
Figure 15:
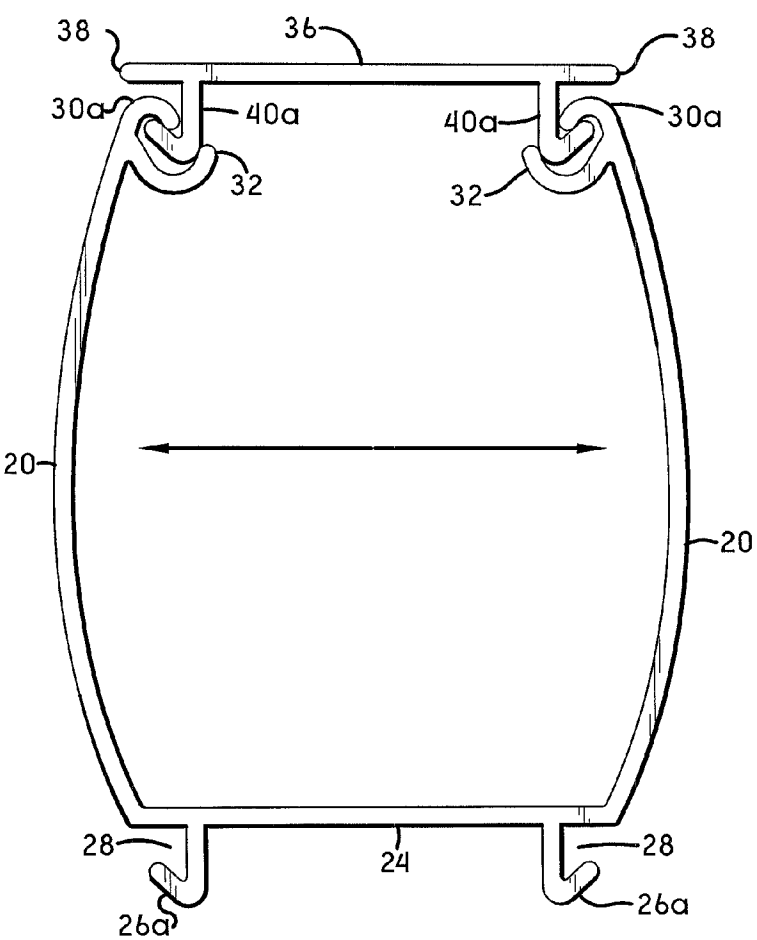
FIG. 15 is an expanded top plan view of the module of FIG. 14 illustrating the application of a laterally expanding outward force (F) in the middle of the module in a manner similar to FIG. 12, and its associated impact on the joint, illustrating the joint becoming more tightly engaged rather than becoming dislodged as illustrated in FIG. 13.
Figure 17:
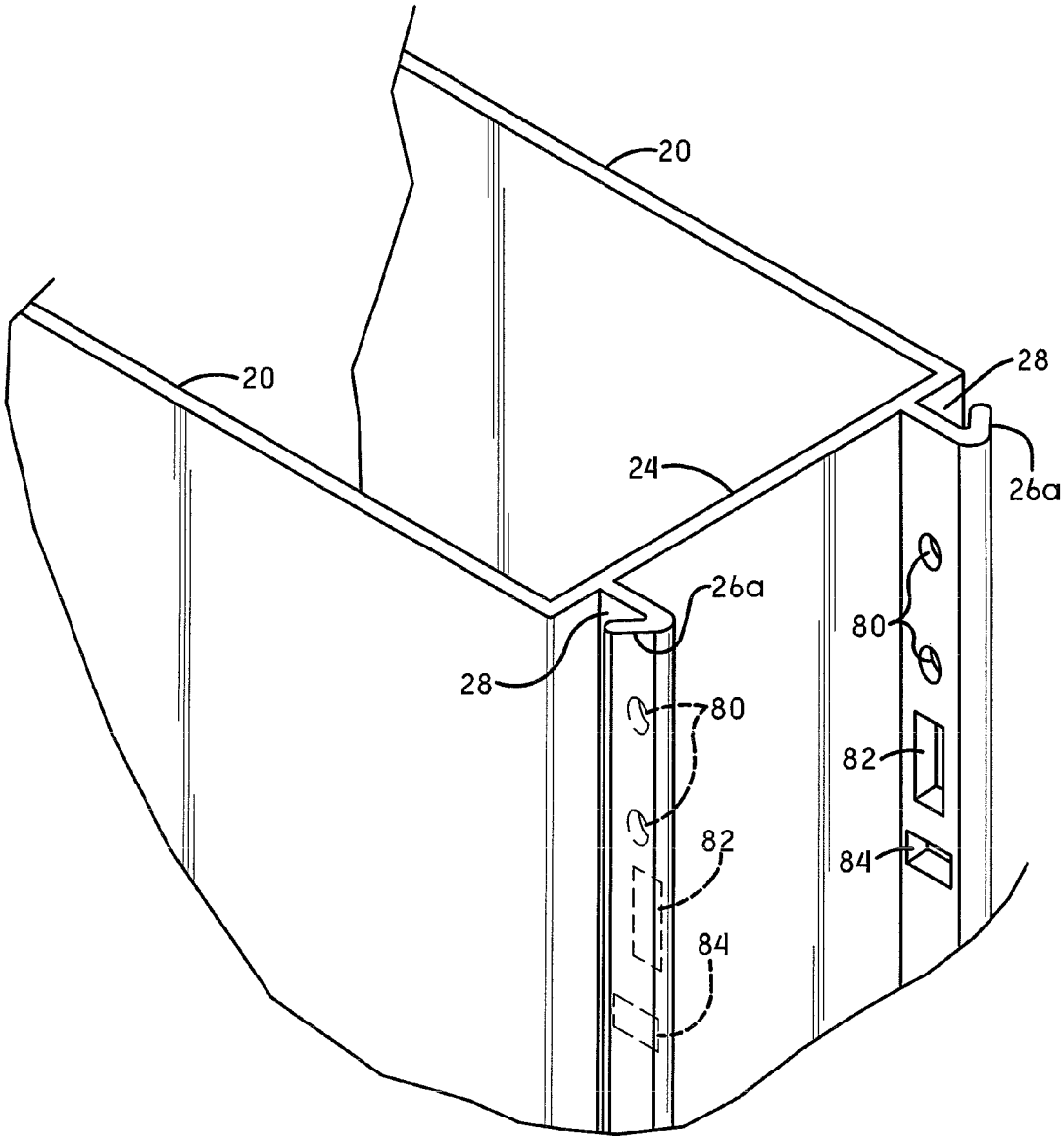
FIG. 17 is an enlarged perspective view of one end of the module illustrated in FIG. 14 showing apertures within an extending finger.
Figure 20:
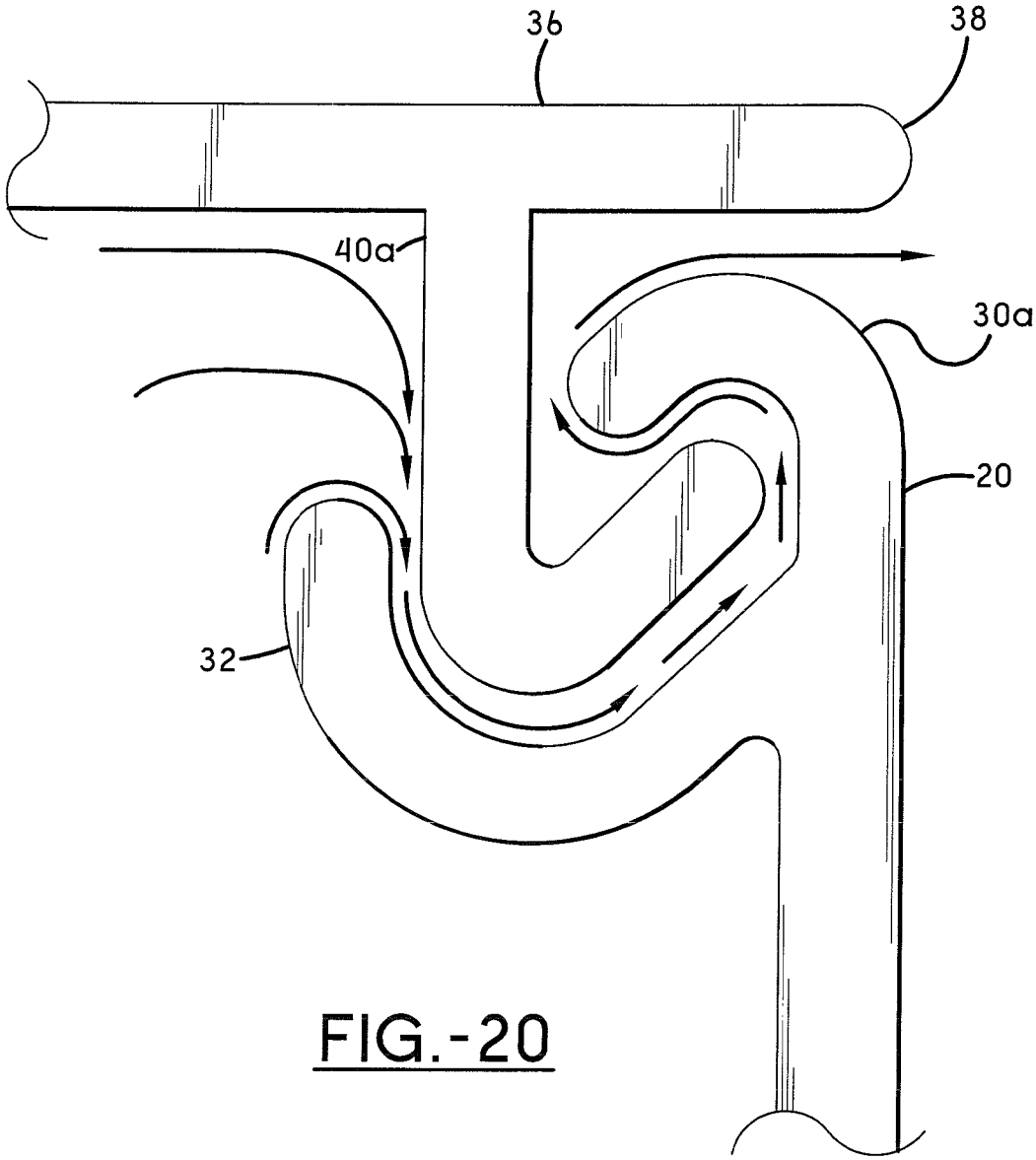
FIG. 20 is an enlarged view illustrating a fluid flow pattern through one mating J-shaped joint.

This additional flow can be achieved in two complementary approaches. The most common is through the design of the joints themselves, through geometric dimensional control which allows for a non-tight fit of the mating fingers of the joints. As illustrated in FIG. 11, inwardly projecting fingers 30, 32 create a vertical channel into which outwardly projecting finger 40 interfaces and mates and joins in a manner in which there is non-contiguous contact along the entire length of the channel, shown in an idealized manner in the figure where essentially equal spacing is illustrated as a gap between the exterior surfaces of the fingers. In a more typical environment, and considering the fact that these modules are pounded into the seabed, it is more likely that some, but not all portions of the exterior of the fingers will be in contacting engagement at different points along the vertical channel within which outwardly facing finger 40 penetrates. Similarly, as better illustrated in FIG. 14, outwardly projecting finger 40*a* within vertical channel 42, created by inwardly projecting fingers 30*a* and 32, is in contacting engagement with only a portion of channel 42. In either figure, water is able to move from one side of the module to the opposed side due to the fact that there is no complete sealing of any surface interposed between the opposed sides of the modules. Alternatively, it is possible to position at least one aperture 80, 82, 84 in at least one vertically extending support or finger 26*a* to allow for water flow as illustrated in FIG. 17. This aspect of the invention may be better illustrated in FIG. 20, in which the arrows indicate a stylized depiction of one possible direction of fluid flow through a joint of the seawall. As illustrated in that figure, each mating pair of fastening means is the combination of two essentially parallel, essentially vertical surfaces, the adjacent surfaces having a gap between at least a portion of the respective vertical surfaces to allow fluid flow therebetween. Therefore, while the surfaces are essentially parallel and adjacent, due to the inherent imperfections in the extrusion process, they are not mirrored surfaces, which might prohibit fluid flow.

As illustrated in all of the Figures, each seawall module is a self-supporting structure that can be driven into the seabed using a vibratory hammer or other appropriate device. In light of this requirement, the thickness of the module, typically constructed of PVC is dependent upon the amount of resistance anticipated to be encountered during installation as well as the number of type of fillers added to the PVC compound. Each wall of the module is essentially solid plastic, optionally with one or two apertures in relatively close proximity to the top of the module to aid in the use of a crane to move the module into position for insertion into the seabed. There is no need for the area to be excavated and trenched prior to installation of any module. In actual construction, the seawall is fabricated starting with the closed end of the module and subsequently extended by attaching other closed end modules or an end cap.

The improved seawall of the present invention has the ability to self-drain. This typically means that the amount of void or open space in the combination male projection/female channel can range in the embodiment illustrated in FIG. 14 to range from approximately 5% open void space to approximately 60% or greater. The male projection typically occupies and fills approximately about 33% to 50% of the female channel. It is understood that these figures may be either greater or smaller depending on the end-use application, the thickness of the walls of the module, etc.

In a preferred embodiment of the invention, the wall thickness will range from approximately 0.25 inches to 0.70 inches, although both higher and lower amounts are within the scope of this invention. The amount of movement of the male projection in the female channel expressed as a percentage of wall thickness ranges between 10%, preferably 20% up to 100% or more.

Figure 14:
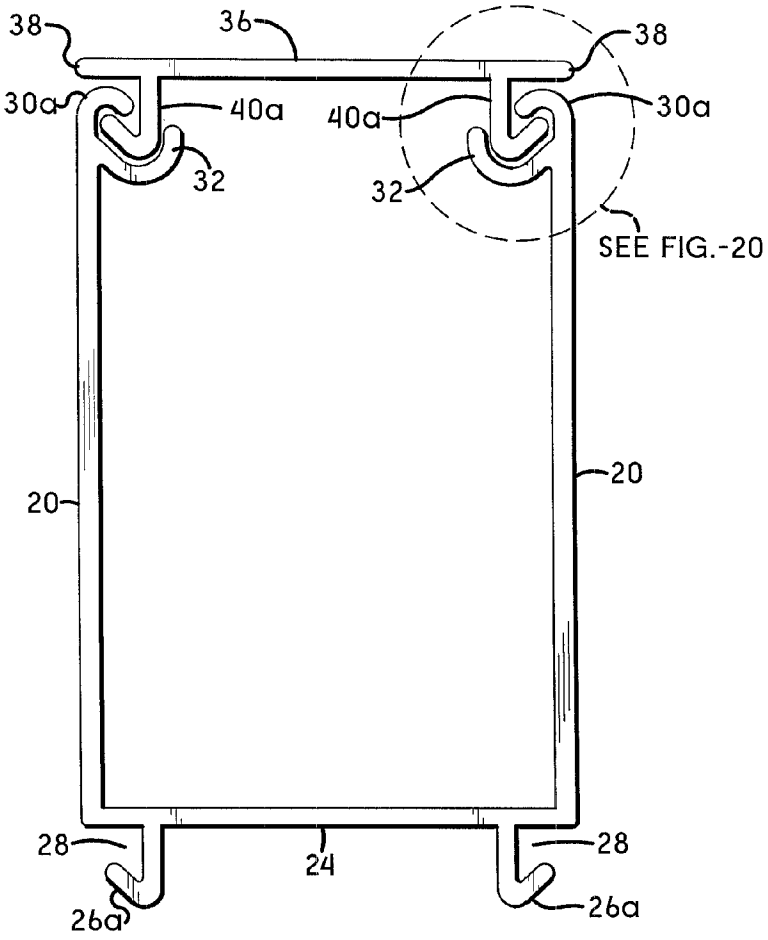
FIG. 14 is an expanded top plan view of an end module of the retaining wall illustrating the fastening of the end module with an open polygon shape with areas of non-contiguous contact or gaps in the joint to allow water or other fluid egress from one side of the wall to the opposite side utilizing two opposed outwardly facing "J-shaped" hooks in the joint.
Figure 16:
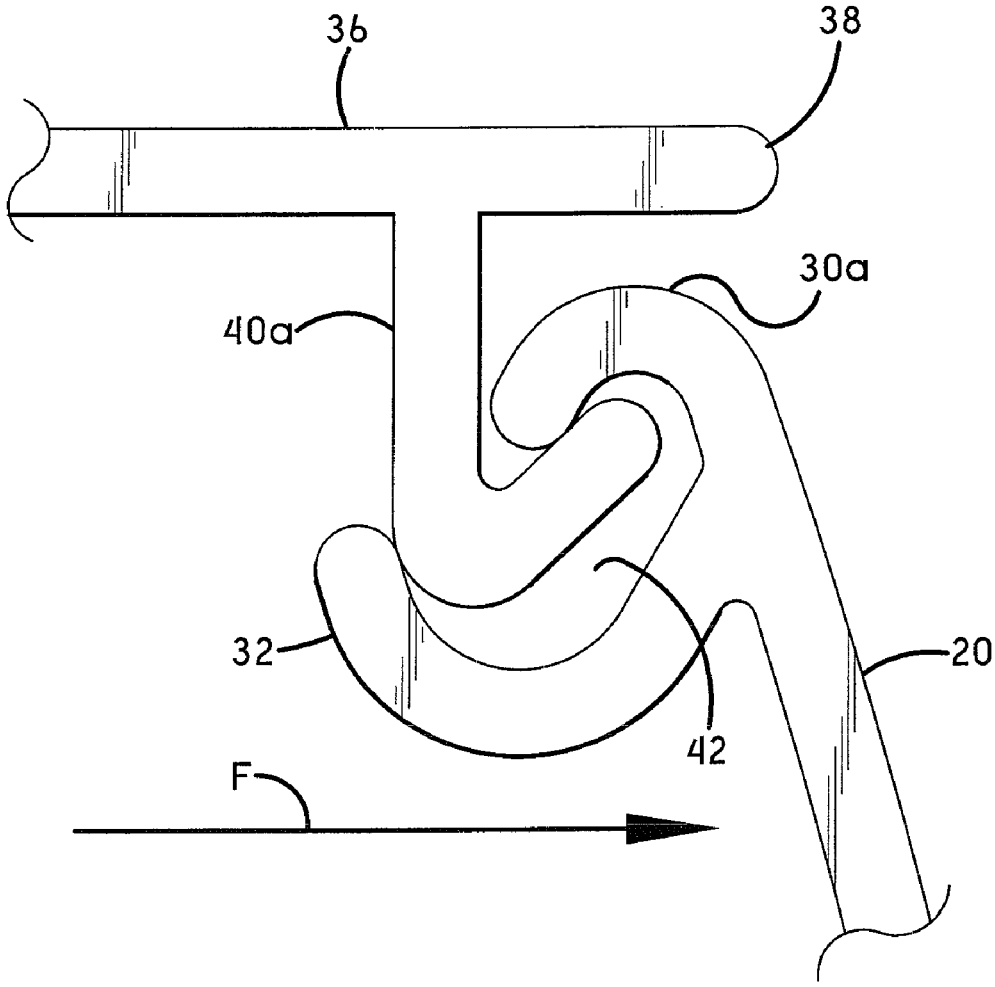
FIG. 16 is an enlarged top plan view of one joint of FIG. 15 upon continued application of a lateral outward force (F) and its associated impact on the joint, illustrating the joint becoming even more firmly attached due to the "J-shaped" configuration, rather than becoming dislodged as illustrated in FIG. 13.

In order to prove the self-draining concept, a modular seawall was constructed in a manner similar to that illustrated in FIG. 14. The wall was six feet high and ten feet long and filled with #57 stone. A French drain was underneath the entire depth of the wall and three feet wide. The soil surface of the French drain was lined with plastic so no water was able to bypass the wall without going through the wall. Initially a flow rate of 20 gallons/minute was poured into the top of the French drain. This was equivalent to an approximate rainfall of about 10 inches per hour of rainfall. At this rate, the water backed up behind the wall to a depth of 5 inches and remained constant. After 20 minutes, the rate was increased to 50 gallons per minute. For this flow rate, the water behind the wall increased to a depth of 13 inches, and then remained constant. Approximately 1200 gallons of water passed through the wall in 35 minutes.

The above results indicate that even during a torrential rainfall, the water level behind the wall will never be more than about 5 inches higher than the canal level. Adding drains through the wall was not required as long as the drain was filled with gravel so that the joints did not clog with fine particles, although the addition of apertures is not precluded.

Another aspect of this invention resides in the essentially flat profile of the seawall when constructed. See U-shaped modules 20 and curved module 46 in FIG. 1 which minimizes the amount and size of the indentations in the adjacent side wall panels. This is important in tidal basin areas where the essentially flat sides, including the joints as there is less eddying, which is a factor in the amount of noise generated adjacent to the seawalls by the tides coming in and out.

In the foregoing description, certain terms have been used for brevity, clearness and understanding; but no unnecessary limitations are to be implied therefrom beyond the requirements of the Prior Art, because such terms are used for descriptive purposes and are intended to be broadly construed. Moreover, the description and illustration of the invention is by way of example, and the scope of the invention is not limited to the exact details shown or described.

This invention has been described in detail with reference to specific embodiments thereof, including the respective best modes for carrying out each embodiment. It shall be understood that these illustrations are by way of example and not by way of limitation.

What is claimed is:

1. A modular wall which comprises:

at least two U-shaped hollow polymeric modules, each of said modules having a closed end and an open end, each module having at least two essentially parallel opposing vertical side panels, each surface of said opposing vertical side panels having a pair of ends, and a vertical transverse panel connecting one pair of ends, each side and transverse panel combination joined to form a vertical edge at said closed end;

said transverse panel having a pair of vertical outwardly-facing J-shaped hooks near said vertical edges and extending a vertical length essentially equal to a length of said vertical edges;

each open end of said polymeric modules having a pair of inwardly-facing fingers which mate with an adjacent outwardly-facing J-shaped hook on an adjacent polymeric module;

said J-shaped hook having a base member which extends from said transverse panel vertically and essentially parallel to said side panels and at least partially bends at an acute angle to said base member;

said mating J-shaped hook and finger combination being in engagement at an acute angle;

each mating J-shaped hook and finger combination comprising two essentially parallel, essentially vertical surfaces, said surfaces having a gap between at least a portion of said vertical surfaces to allow fluid flow therebetween;

either of said two essentially parallel, essentially vertical surfaces for said mating J-shaped hook and fingers combination contains at least one aperture; and a depth of said fingers and a penetration depth of said J-shaped hook being essentially equal to minimize a size of indentations between adjacent side wall panels in said wall when said modules are interconnected.

2. The wall of claim 1 which further comprises at least one polymeric end cap having a pair of outwardly-facing J-shaped hooks;

each hook having a base member which extend from said polymeric end cap vertically and essentially parallel to said side panels and at least partially bends at an acute angle to said base member and further wherein; and each J-shaped hook matingly engages one of said inwardly-facing fingers at said acute angle.

3. The wall of claim 1 which further comprises a support rib within at least one U-shaped module; and each end of said support rib in engagement with an interior fastening means on each of said side panels.

4. A modular wall which comprises:

at least two U-shaped hollow polymeric modules, each of said modules having a closed end and an open end, each module having at least two essentially parallel opposing vertical side panels, each surface of said opposing vertical side panels having a pair of ends, and a vertical transverse panel connecting one pair of ends, each side and transverse panel combination joined to form a vertical edge at said closed end;

said transverse panel having a pair of vertical outwardly-facing J-shaped hooks near said vertical edges and extending a vertical length essentially equal to a length of said vertical edges;

each open end of said polymeric modules having a pair of inwardly-facing fingers which mate with an adjacent outwardly-facing J-shaped hook on an adjacent polymeric module;

said J-shaped hook having a base member which extends from said transverse panel vertically and essentially parallel to said side panels and at least partially bends at an acute angle to said base member;

said mating J-shaped hook and finger combination being in engagement;

each mating J-shaped hook and finger combination comprising two essentially parallel, essentially vertical surfaces, said surfaces having a gap between at least a portion of said vertical surfaces to allow fluid flow therebetween;

either of said two essentially parallel, essentially vertical surfaces for said mating J shaped hook and fingers combination contains at least one aperture; and a depth of said fingers and a penetration depth of said J-shaped hook being essentially equal to minimize a size of indentations between adjacent side wall panels in said wall when said modules are interconnected.

5. The wall of claim 4 which further comprises at least one polymeric end cap having a pair of outwardly-facing J-shaped hooks;

each hook having a base member which extend from said polymeric end cap vertically and essentially parallel to said side panels and at least partially bends at an acute angle to said base member and further wherein; and each J-shaped hook matingly engages one of said inwardly-facing fingers.

6. The wall of claim 4 which further comprises a support rib within at least one U-shaped module; and each end of said support rib in engagement with an interior fastening means on each of said side panels.

* * * * *